US005562385A

United States Patent [19]

Tacchi et al.

[11] Patent Number: 5,562,385

[45] Date of Patent: Oct. 8, 1996

[54] APPARATUS FOR LOADING REELS INTO A PACKAGING MACHINE

[75] Inventors: Alver Tacchi; Antonio Gamberini, both of Bologna, Italy

[73] Assignee: G.D. S.p.A., Bologna, Italy

[21] Appl. No.: 267,759

[22] Filed: Jul. 5, 1994

[30] Foreign Application Priority Data

Jul. 16, 1993 [IT] Italy ..... BO93A0326

[51] Int. Cl.[6] ..... B65H 19/30

[52] U.S. Cl. ..... 414/391; 242/559.4; 414/396; 414/590; 414/911

[58] Field of Search ..... 414/391, 396, 414/399, 427, 590, 609, 630, 633, 637, 662, 672, 911; 242/35.5 A, 559.4

[56] References Cited

U.S. PATENT DOCUMENTS

| | | | |
|---|---|---|---|
| 4,153,211 | 5/1979 | Lenk et al. | 242/35.5 A |
| 4,281,959 | 8/1981 | Minnetti | 414/590 X |
| 4,927,090 | 5/1990 | Matsumoto | 414/911 X |
| 4,997,336 | 3/1991 | Galbani | 414/911 X |
| 5,007,522 | 4/1991 | Focke et al. | 414/391 X |
| 5,096,357 | 3/1992 | Galbani | 414/911 X |
| 5,263,805 | 11/1993 | Brizzi et al. | 414/391 |
| 5,332,351 | 7/1994 | Nelson et al. | 414/911 X |
| 5,431,521 | 7/1995 | Napierkowski et al. | 414/396 X |

FOREIGN PATENT DOCUMENTS

| | | |
|---|---|---|
| 2103672 | 2/1983 | United Kingdom . |
| 2244982 | 12/1991 | United Kingdom . |
| 2262499 | 6/1993 | United Kingdom . |

*Primary Examiner*—Karen Merritt
*Assistant Examiner*—James W. Keenan
*Attorney, Agent, or Firm*—Guido Modiano; Albert Josif

[57] ABSTRACT

An apparatus for loading reels into a packaging machine comprises a loading device that has a post rotating about a vertical axis under the actuation of a drive unit; a lifting element, which is provided with elements for supporting a reel to be loaded and is guided so that it can slide longitudinally with respect to the post and can move under the actuation of an additional drive unit between a lowered position for picking up the reel and a raised position for transferring the reel to the packaging machine; and sensors for controlling respectively the angular rotation of the post and the coordinated longitudinal sliding movement of the lifting element.

19 Claims, 5 Drawing Sheets

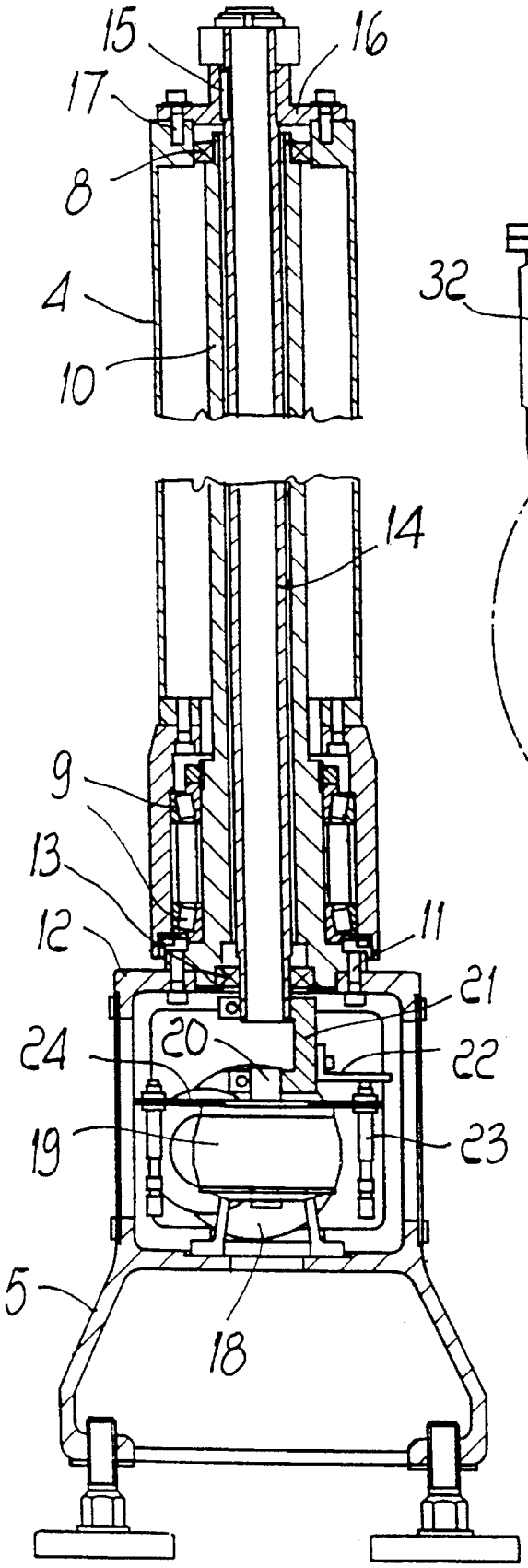
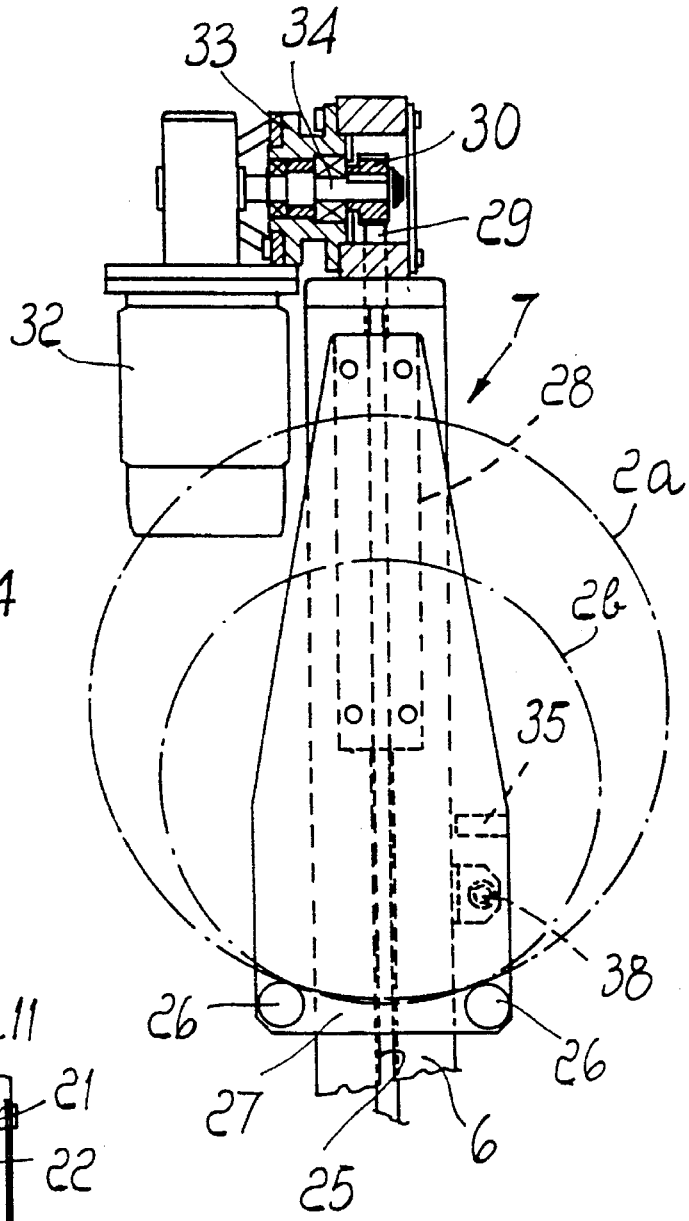
FIG.4
FIG.3

APPARATUS FOR LOADING REELS INTO A PACKAGING MACHINE

BACKGROUND OF THE INVENTION

The present invention relates to an apparatus for loading reels into a packaging machine.

In particular, the present invention relates to an apparatus for loading reels of wrapping material in the reserve magazine of a machine that uses said material in bands for wrapping or packaging.

In the field of automatic packaging machines of the above type, it is known to use a reserve magazine which supports a plurality of reels arranged side by side. The reels to be used are taken one at a time from said reserve magazine and are fed to elements that replace said reels in the packaging machine.

When the used reel is depleted, the replacement elements feed a subsequent reel to the machine. This allows to make the packaging machine independent for relatively long periods.

In order to limit overall bulk, the reserve magazine of the reels is preferably arranged in a region overlying the packaging machine.

The need has thus arisen to automatically load the reels in the reserve magazine of the packaging machine. Various loading devices, capable of lifting items to a certain height and of transferring them from the position in which they are supplied to the position for loading in the magazine, generally by means of an angular rotation, are currently available for this purpose.

Conventional loading devices usually have an arm for supporting the items to be loaded, which is slideably supported on a vertical post transversely to said post and is actuatable by appropriate reciprocating-motion elements, for example of the pneumatically-actuated or mechanical type. In particular, the vertical translatory motion of the loading arm is often driven by means of a threaded shaft which is arranged coaxially inside said post and is coupled to a lead-nut element associated with said loading arm. By rotationally actuating the threaded shaft, or as an alternative the lead nut coupled thereto, by means of an appropriate drive unit, the loading arm is made to slide and is appropriately guided longitudinally with respect to the post.

The loading arm is caused to perform an angular rotation by means of appropriate cams or slots formed in the post.

Generally, conventional loading devices are rather complicated and usually do not achieve the required versatility in use. In particular, the reciprocating vertical movement of the loading means is rigidly preset; the angular rotation of the device is equally preset.

SUMMARY OF THE INVENTION

A principal aim of the present invention is to solve the above problem by means of an apparatus that allows to load reels into a packaging machine, ensuring maximum simplicity and versatility in use.

An object of the present invention is to provide an apparatus which has a limited bulk, is easy to use and safely reliable in operation.

With this aim and this object in view, the present invention provides an apparatus for loading reels into a packaging machine, which is characterized in that it comprises: a loading device provided with a post rotating about a vertical axis under the actuation of a drive unit; a lifting element, which is provided with means for supporting a reel to be loaded and is guided so that it can slide longitudinally with respect to said post and can move under the actuation of an additional drive unit between a lowered position for picking up said reel and a raised position for transferring said reel to said packaging machine; and sensor means for controlling respectively the angular rotation of said post and the coordinated longitudinal sliding movement of said lifting element.

BRIEF DESCRIPTION OF THE DRAWINGS

Further details and advantages of the apparatus for loading reels into a packaging machine according to the invention will become apparent from the following detailed description of a preferred but not exclusive embodiment thereof, illustrated only by way of non-limitative example in the accompanying drawings, wherein:

FIG. 3 is a sectional view of the apparatus, taken along the plane III—III of FIG. 1;

FIG. 4 is a front view of a detail of said loading device;

DESCRIPTION OF THE PREFERRED EMBODIMENTS

Figure 1:
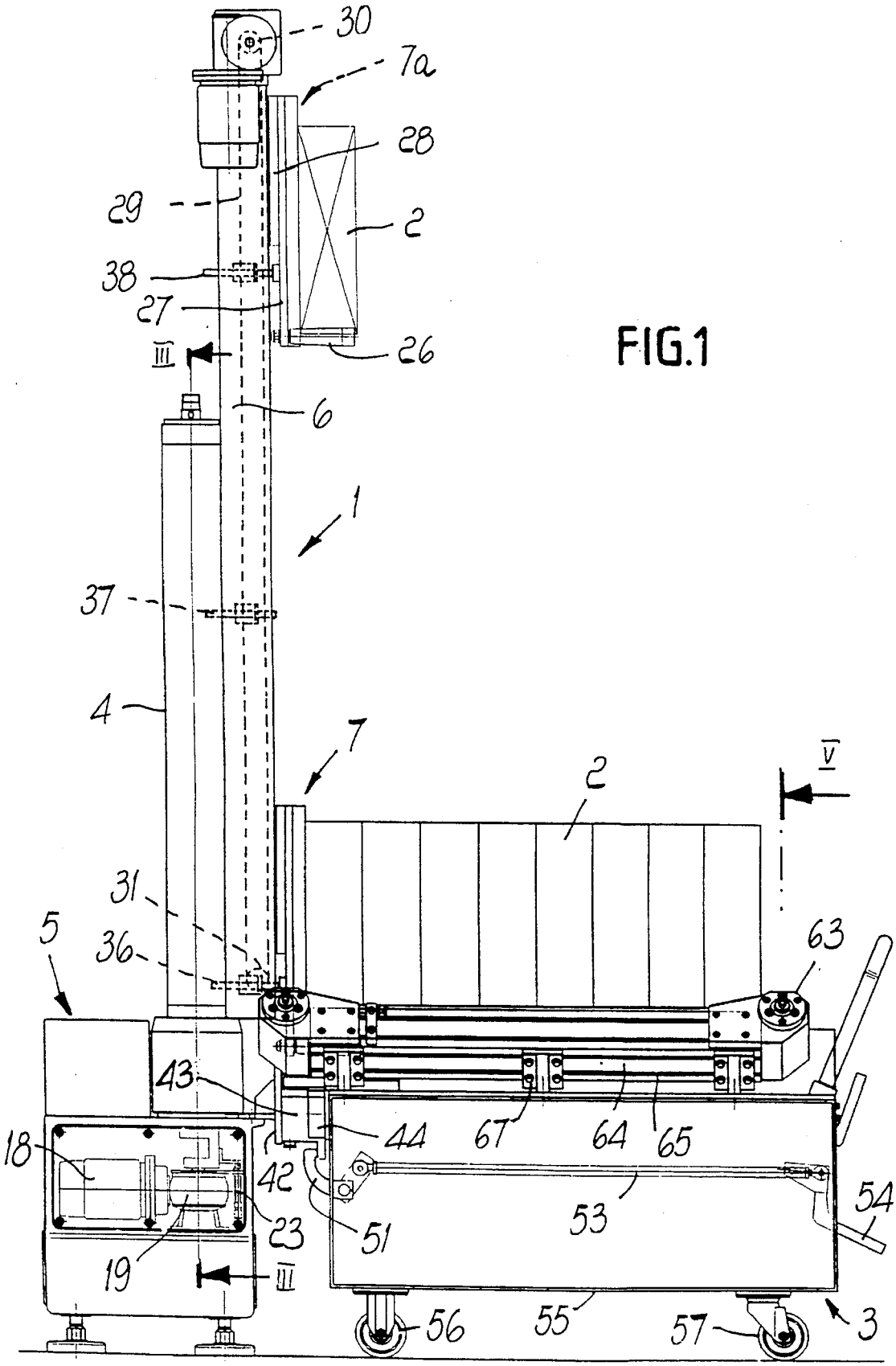
FIG. 1 is an elevation view of the loading apparatus according to the invention.

With reference to the above figures, the reference numeral 1 generally designates a device for loading the reels 2 of wrapping material in the reserve magazine of a conventional packaging machine, not shown in the drawings. The reels 2 to be loaded are fed to the device 1 by means of a cart 3 on which said reels 2 are arranged mutually side by side so that their axes are aligned.

The loading device 1 has a post 4 which is mounted above a footing 5 so that it can rotate about a vertical axis. An auxiliary post 6 is fixed to one face of the post 4, which preferably has a square cross-section; said auxiliary post extends vertically above the top of said post 4 and is suitable to guide an element 7 for lifting the reels 2.

More particularly, as shown in FIG. 3, the post 4 has a tubular shape and is rotatably mounted, by means of the interposition of rolling bearings 8 and 9, on a sleeve 10 which substantially extends along the entire length of said post 4. The sleeve 10 is fixed, at its base, to the footing 5 in an angularly adjustable position by virtue of screw means 11 which engage a plurality of holes correspondingly formed on a flat surface 12 of the footing 5.

A preferably tubular shaft 14 is rotatably supported inside the sleeve 10 by means of the interposition of rolling bearings 13. The shaft 14 protrudes above the sleeve 10 and is rigidly coupled, by virtue of keying means 15, to an upper head 16 which is fixed to the post 4 by screw means 17 of its own.

The shaft 14 is rotationally actuatable, at its base, by a drive unit comprising a gearmotor 18 which is accommodated inside the footing 5 and has an associated reduction unit 19. The shaft 14 is connected to the output shaft 20 of the gearmotor 18 and 19 by means of a coupling 21. An abutment 22 is transversely fixed to said coupling 21 and is suitable to activate a plurality of sensors 23 peripherally supported by a plate 24 which is rigidly coupled to the gearmotor.

The auxiliary post 6 is tubular, preferably with a square cross-section, and is frontally provided with a longitudinal slot 25 suitable to act as a guide for the sliding of the lifting element 7 (see FIG. 4).

Said lifting element 7 substantially comprises two pins 26 which are arranged side by side and protrude horizontally at the base of a backing panel 27 in a fork-like arrangement. The pins 26 are suitable to act as a lower support for the reel 2 to be loaded. In particular, the pins 26 form two supporting points for reels having different diameters, as designated by the reference numerals 2*a* and 2*b* in FIG. 4.

It should be noted that the pins 26 have a slight taper, so as to tilt the reel 2 against the backing panel 27, in order to ensure stability of the supporting action.

The backing panel 27 is fixed to a plate 28 which is guided through the longitudinal slot 25 of the post 6 and is rigidly coupled to a drive belt 29 arranged inside the auxiliary post 6. The belt 29 winds around two pulleys 30 and 31 which are rotatably arranged at the upper and lower ends of the post 6 respectively. The belt 29 is movable in alternating directions by means of an additional drive unit 32 which is supported in a cantilevered manner at the top of the post 6 by means of a flange 33. The pulley 30 for driving the belt 29 is keyed on the output shaft 34 of the drive unit 32.

The backing panel 27 is provided, at the rear, with an abutment 35 for activating multiple further sensor elements 36, 37 and 38 which are appropriately distributed along the auxiliary post 6 of the loading device 1. In particular, the lower sensor 36 and the upper sensor 38 are suitable to report the movement of the lifting element 7 into a lowered position and into a raised position respectively, whereas the intermediate sensor 37 is suitable to report the disengagement of said lifting element 7 from the region where the cart 3 feeds the reels 2.

Figure 2:
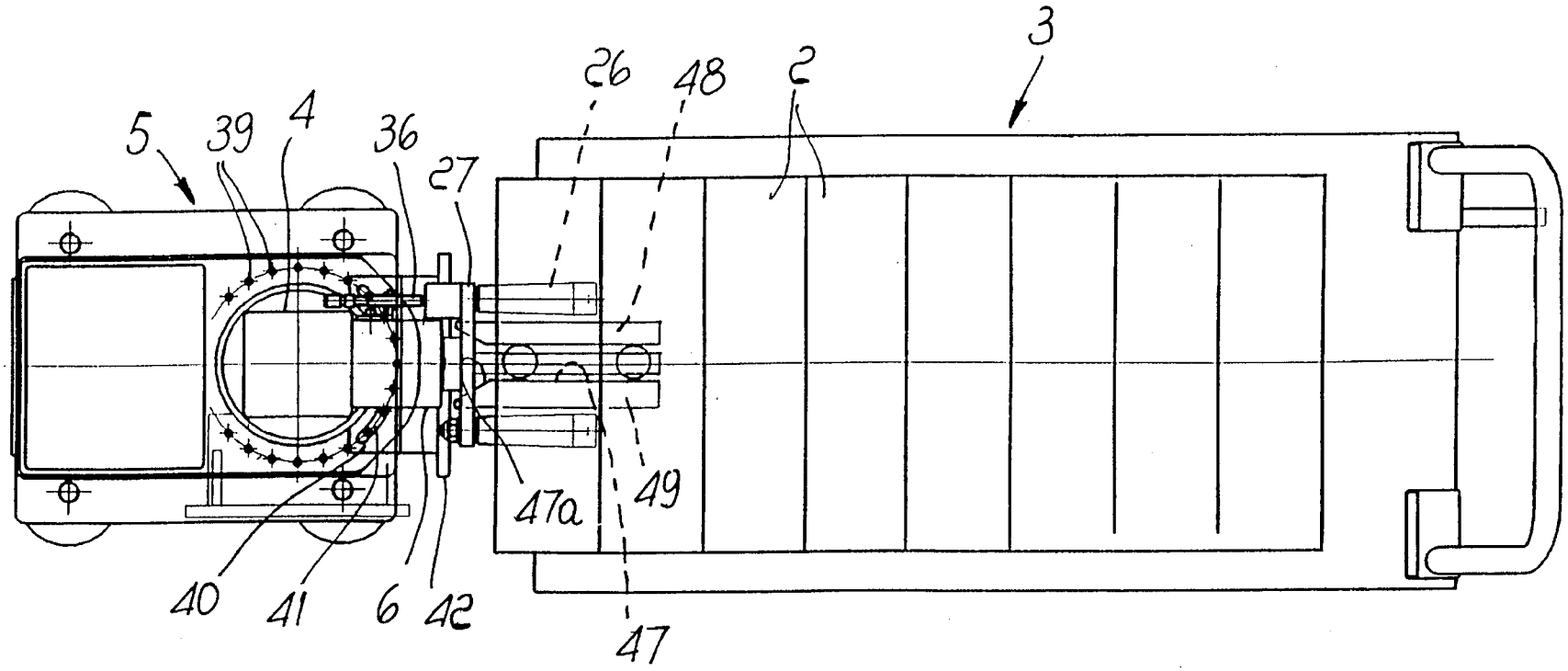
FIG. 2 is a corresponding plan view of said apparatus.

A series of holes 39 is formed on the flat surface 12 of the footing 5 along a circular arc which is concentric to the post 4; said holes are suitable to fix a platform 40 in an adjustable position. Said platform 40 has, along a circular arc that matches the holes 39, a slot 41 meant to be crossed by suitable screw fixing means (FIG. 2).

A front wall 42 is rigidly coupled to the platform 40 and acts as a support for connection elements 43 suitable for electrical and mechanical coupling to elements 44 which are complementary thereto and protrude frontally from the cart 3 for feeding the reels 2.

Figure 7:
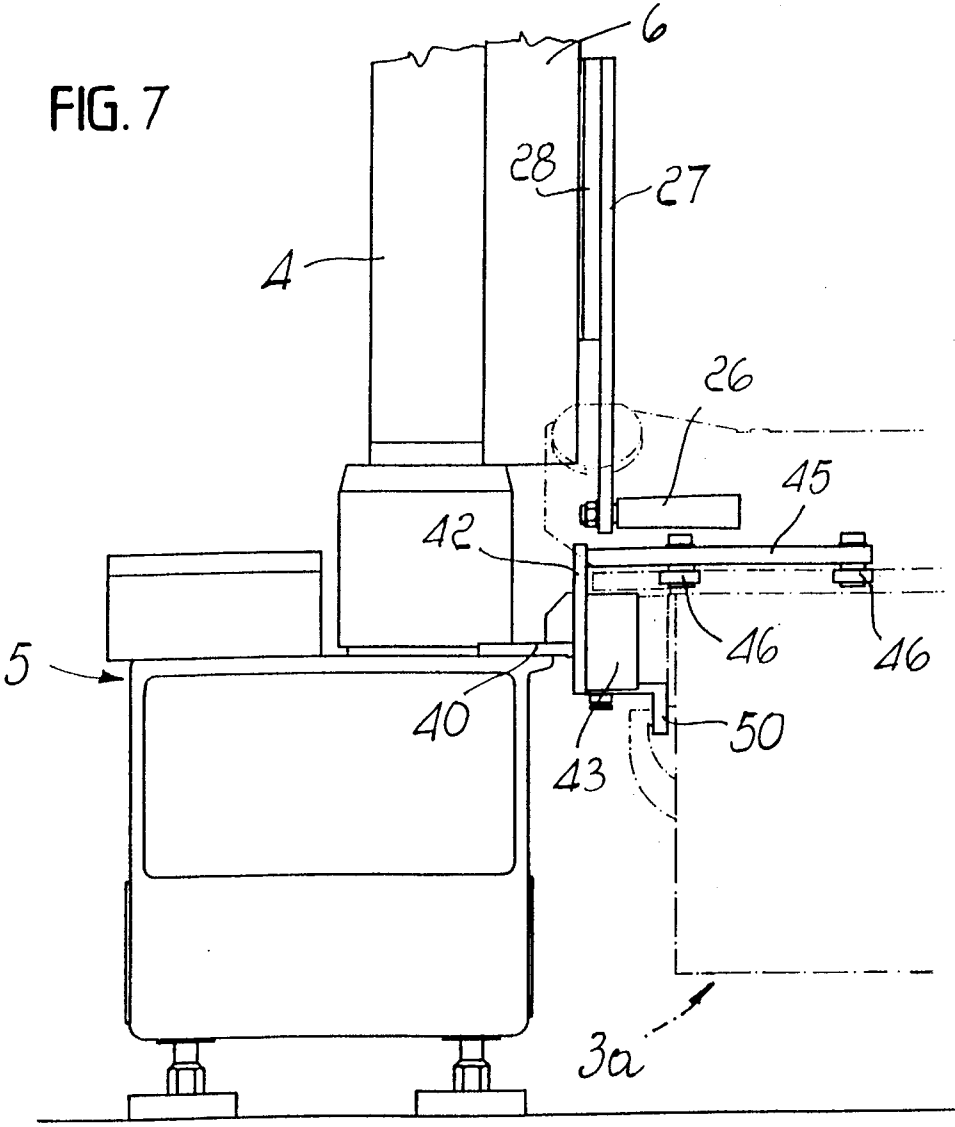
FIG. 7 is an elevation view of the region for the connection of said loading device to said cart.

A rod 45 protrudes horizontally from the wall 42 above the coupling elements 43 and supports, so that they can rotate about vertical axes, two centering rollers 46 which are shown in FIG. 7. Said centering rollers 46 are engageable with a guide 47, shown in FIG. 2, which is arranged longitudinally in the median portion of the cart 3, is formed between two plates 48 and 49 which are rigidly coupled to the cart 3 and has a flared inlet 47*a*.

An L-shaped element 50 furthermore protrudes downward from the wall 42 and is meant to be engaged by a hook 51 which is pivoted to the front of the cart 3. The hook 51 is associated with a lever system 52 articulated to a traction element 53 which can be actuated, at the opposite end of the cart 3, by means of an actuation lever 54.

The cart 3 comprises a chassis 55 mounted on pairs of front wheels 56 and rear wheels 57; the rear wheels 57 are preferably steerable.

Figure 5:
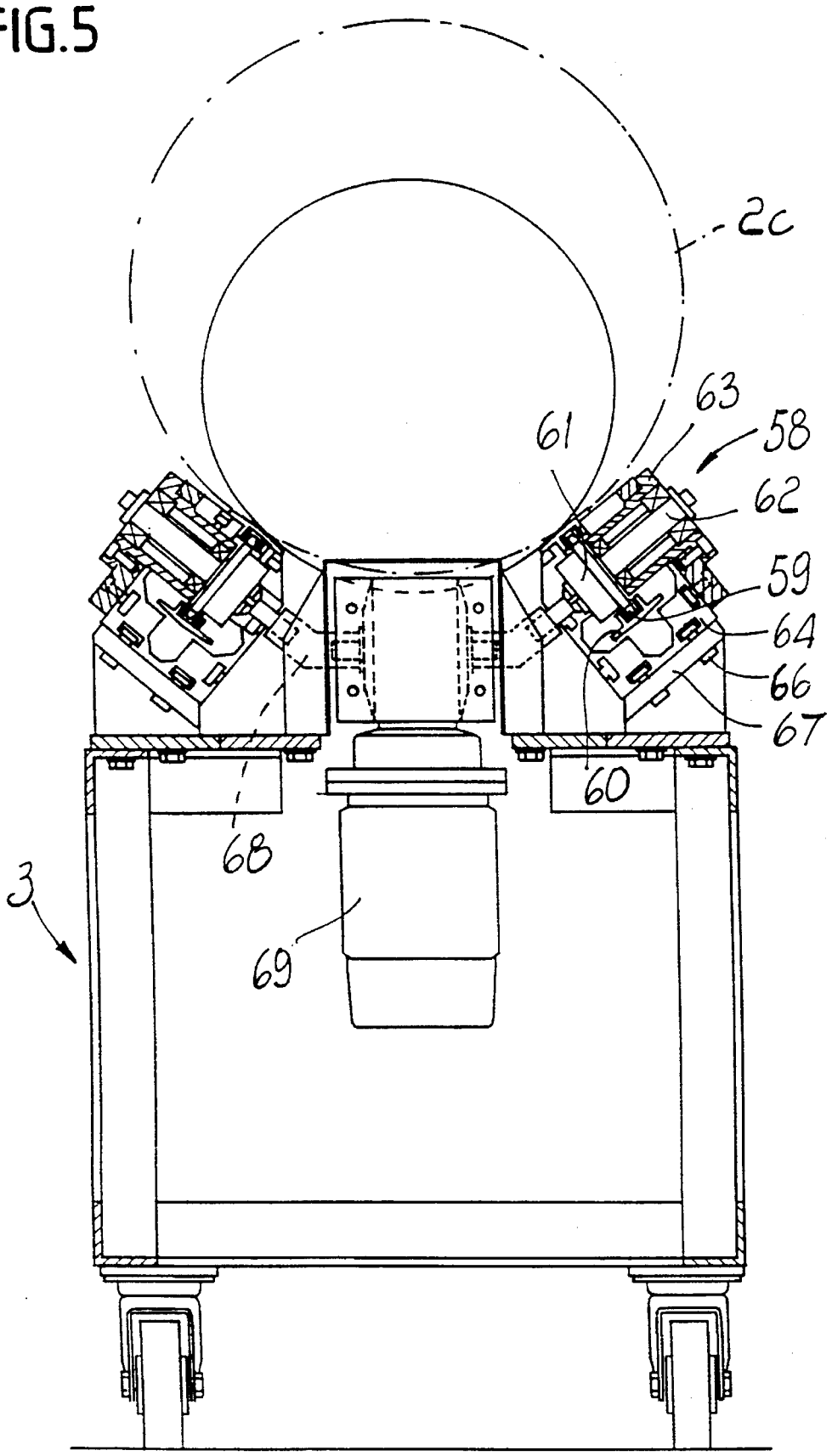
FIG. 5 is a transverse sectional view of a cart for feeding the reels, taken along the plane V—V of FIG. 1.
Figure 6:
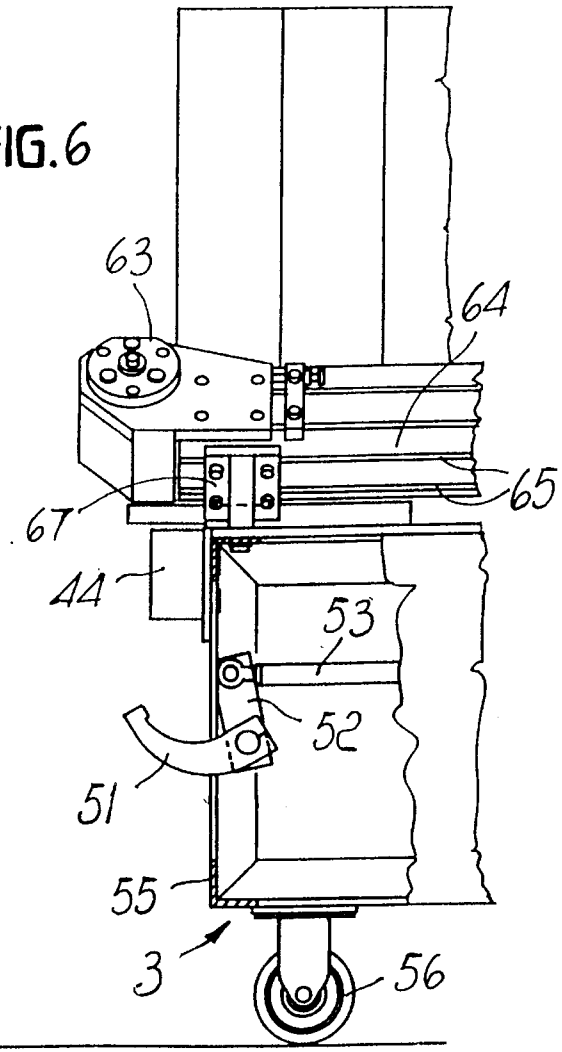
FIG. 6 is a plan view of a detail of said cart.

The cart 3 is provided, in an upward region, with means for supporting and transferring the reels 2, which are generally designated by the reference numeral 58. The transfer and support means 58 are constituted by two chain elements 59 arranged symmetrically on the longitudinal sides of the cart 3 on oblique planes that converge upward and have segments 60; the reels 2 are arranged in series, side by side, on planes which are transverse to the cart 3, so as to rest on the segments 60 of the upper portions of the chain elements 59. Conveniently, the segments 60 have a rounded external profile so that they are tangent to the reels 2 regardless of the diametrical dimensions of said reels 2 (see FIG. 5).

The chain elements 59 wind respectively around two sprocket wheels 61 mounted on shafts 62 which are rotatably supported by related heads 63. Said heads 63 are fixed to the ends of a corresponding pair of profiled elements 64 that lie longitudinally with respect to the cart 3. The profiled elements 64 have longitudinal slots 65 for engaging the head of screw elements 66 for fixing to a plurality of supports 67 which are rigidly coupled to the cart 3.

At one end of the cart 3, the shafts 62 of the sprocket wheels 61 are coupled, by means of related joints 68, to a drive unit 69 for actuating the chain elements 59.

The operation of the described apparatus is now illustrated starting from the moment when the lifting element 7 is in a lowered position, at the base of the auxiliary post 6, and is therefore ready to receive a reel 2 from the cart 3 (FIG. 7).

The cart 3 is moved towards the loading device 1 so as to insert the centering rollers 46 in the guide 47 of said cart 3. The cart 3 is pushed into abutment against the device 1 until the mutually complementary elements 43 and 44 for electrical and mechanical connection couple to each other, as shown by the dashed line 3*a* in FIG. 7.

The cart 3 is then secured to the loading device 1 by means of the hook 51, which engages the L-shaped element 50 by being actuated by the traction element 53.

In this configuration, the pins 26 of the lifting element 7 are inserted below the first one of the reels 2 which are supported in a row by the cart 3. By moving the lifting element 7 upward said reel 2 is therefore removed from the cart 3. The lifting of the lifting element 7, guided along the longitudinal slot 25 of the post 6, is driven by the motor 32, which drives the belt 29 to which the backing panel 27 of the lifting element 7 is rigidly coupled.

When the lifting element 7 affects the intermediate sensor 37 by means of the abutment 35 during its ascending motion, the disengagement of said lifting element 7 from the region where the cart 3 feeds the reels 2 is reported. It is thus possible to actuate the angular rotation of the post 4, which obviously produces the simultaneous rotation of the lifting element 7 with respect to the axis of said post 4, so as to direct the reel 2 towards the reserve magazine of the packaging machine.

The angular rotation of the post 4, which is equal for example to an angle of 180°, is actuated by the motor 18 which drives the tubular shaft 14, and is controlled by the sensors 23 that allow to set the stop positions.

When the lifting element 7 reaches the intended raised position, indicated by the activation of the upper sensor 38, movement is halted. For the sake of greater clarity, in FIG. 1 said raised position, designated by the reference numeral 7*a*, has been shown vertically aligned with respect to the lowered position, i.e. without providing for angular rotation.

After the reel 2 carried by the lifting element 7 has been picked up by appropriate conveyor elements, not shown, and loaded in the magazine of the packaging machine, the above described operations are repeated in reverse, so as to return the lifting element 7 to the initial lowered position. The activation of the lower sensor 36 reports that said lowered position has been reached and causes the lifting element 7 to halt.

The means 58 for supporting and transferring the reels 2 onto the cart 3 are then made to advance so as to feed a subsequent reel to the lifting element 7. This advancement is driven by the motor 69, which is electrically powered by the loading device 1, to which it is connected by means of the electric coupling of the elements 43 and 44. Of course it is possible to provide the cart 3 with independent means for supplying electric power to the motor 69 thereof.

In summary, the apparatus according to the present invention allows to very easily load the reels 2 of band-like material in the reserve magazine of a packaging machine, limiting the intervention of the assigned personnel to the mere movement of the cart 3 that supports the reels to be loaded.

The apparatus is highly versatile in use, so as to ideally solve the problem of loading reels into the packaging machine. It is in fact possible to appropriately vary the lifting height of the reels by adjusting the position of the upper sensor 38 that stops the lifting element 7. In a similar manner it is possible to adjust the extent of the angular rotation of the lifting element 7 by means of the placement of the sensors 23 that control the rotation of the post 4.

It is furthermore possible to appropriately adjust the position of the elements which, on the loading device 1, allow connection to the cart 3 for feeding the reels 2. For this purpose the platform 40 which bears the connection means 43 can in fact be fixed in different angular positions on the flat surface 12 of the footing 5 of the loading device 1 by means of the slot 41. In this manner the cart 3 can be moved towards the loading device 1 along the most convenient axial direction according to the dimensions and position of the packaging machine.

The arrangement of the cart 3 adjacent to the loading device 1 is facilitated by the guide 47 in which the centering rollers 46 engage. The hook 51 ensures the locking of the cart 3 to the loading device 1 in the mutual coupling position.

It should be noted that the reel 2 is removed from the cart 3 in a particularly simple manner by the lifting device 7, in practice by lifting said reel 2 by means of the fork constituted by the pair of pins 26. The reel supporting, transfer and lifting functions performed by the apparatus are independent, as mentioned, of the diametrical dimensions of said reels.

The device furthermore has a very modest bulk which is limited in practice to the bulk of the post on which the reel lifting element can slide.

In the practical execution of the present invention, the materials employed, as well as the shapes and dimensions, may vary according to the requirements.

What is claimed is:

1. Apparatus for loading reels into a packaging machine comprising:

a loading device including a rotatable post;

a drive unit for rotating said post;

a lifting element;

means for supporting a reel to be loaded, said supporting means being provided on said lifting element;

guiding means provided longitudinally along said post, said lifting element being slideably guidable by said guiding means along said post;

an additional drive unit for driving said lifting element between a lowered position for picking up a reel and a raised position for transferring said reel to said packaging machine;

sensor means for controlling an angular rotation of said post; and further sensor means for controlling a coordinated longitudinal sliding movement of said lifting element along said guiding means, said further sensor means comprising: a lower sensor and an upper sensor, adapted to report a movement of said lifting element respectively in said lowered and raised positions; and an intermediate sensor, adapted to report a disengagement of said lifting element from a region where said reels are fed, said lower, upper and intermediate sensors being arranged in positions appropriately distributed longitudinally with respect to said post.

2. Apparatus according to claim 1, further comprising abutment means provided at said driving unit for interacting with said sensor means to control the angular rotation of said post.

3. Apparatus according to claim 1, further comprising connection means for connecting said loading device to a cart for feeding the reels to be loaded, said cart being adapted to cooperate with said lifting element in said lowered pickup position.

4. Apparatus according to claim 3, wherein said connection means are supported by a platform, said platform being fixed on a footing, said post being rotatably supported on said footing for being fixed at positions which are angularly adjustable with respect to a vertical axis of said post.

5. Apparatus according to claim 4, further comprising a rod protruding horizontally from said platform; centering rollers rotatably supported on said rod for rotating about a vertical axis, said rollers being adapted to engage a guide which lies longitudinally in a median region of said cart; and L-shaped means adapted to be engaged by a hook which is pivoted at the front of said cart.

6. Apparatus according to claim 4, wherein said platform is fixable in different angular positions with respect to a flat portion of said footing, whereby said connection means supported on said platform allows connection of said cart along a most convenient angular direction.

7. Apparatus according to claim 1, further comprising a tubular auxiliary post being fixed to one side of said post and lying longitudinally with respect to said post, said auxiliary post being adapted to act as a guide for said reel lifting element; means for slidingly moving said lifting element being arranged inside said auxiliary post, said means for slidingly moving said lifting element being actuated by said additional drive unit.

8. Apparatus according to claim 1, wherein said post has a tubular shape and is rotatably mounted on a sleeve, said sleeve being fixed, at a base thereof, to a footing, a shaft being rotatably supported inside said sleeve, said shaft being rigidly coupled to said post at a top thereof, said shaft being rotationally actuatable at a base thereof by said drive unit, said drive unit for rotating said post being accommodated inside said footing.

9. Apparatus according to claim 1, wherein said lifting element comprises two pins which are arranged side by side and protrude horizontally, in a fork-like manner, at the base of a backing panel, said backing panel being connected to means for slidingly moving said lifting element, whereby said panel is guided longitudinally with respect to said post, said pins having a slight taper so as to incline a reel resting thereon against said backing panel.

10. Apparatus according to claim 9, further comprising a cart for feeding the reels to be loaded, said cart being adapted to cooperate with said lifting element in said lowered pickup position, wherein said pins form two supporting points for reels having different diameters, the reels being supported and transferred in a row in an upward region of said cart up to said lowered position for picking up a reel, means for supporting and transferring the reels being provided on said cart, said means being constituted by two chain-like elements which are arranged symmetrically on the longitudinal sides of said cart, on oblique planes that converge upward, said chain elements having contoured segments adapted to act as supports for said reels.

11. Apparatus according to claim 1, wherein the position of said upper sensor is adjustable longitudinally with respect to said post for varying a lifting height of said lifting element.

12. Apparatus for loading reels into a packaging machine comprising:

a loading device including a rotatable post;

a drive unit for rotating said post;

a lifting element;

means for supporting a reel to be loaded, said supporting means being provided on said lifting element;

guiding means provided longitudinally along said post, said lifting element being slideably guidable by said guiding means along said post;

an additional drive unit for driving said lifting element between a lowered position for picking up a reel and a raised position for transferring said reel to said packaging machine;

sensor means for controlling angular rotation of said post;

further sensor means for controlling a coordinated longitudinal sliding movement of said lifting element along said guiding means between said lowered position for picking up a reel and said raised position for transferring said reel to said packaging machine; and connection means for connecting said loading device to a cart for feeding the reels to be loaded, said connection means being supported by a platform provided on a footing of said loading device, said platform being fixable in different angular positions with respect to a flat portion of said footing, whereby said connection means supported on said platform allows connection of said cart along a most convenient angular direction.

13. Apparatus according to claim 12, further comprising a tubular auxiliary post being fixed to one side of said post and lying longitudinally with respect to said post, said auxiliary post being adapted to act as a guide for said reel lifting element; means for slidingly moving said lifting element being arranged inside said auxiliary post, said means for slidingly moving said lifting element being actuated by said additional drive unit.

14. Apparatus according to claim 12, wherein said post has a tubular shape and is rotatably mounted on a sleeve, said sleeve being fixed, at a base thereof, to said footing, a shaft being rotatably supported inside said sleeve, said shaft being rigidly coupled to said post at a top thereof, said shaft being rotationally actuatable at a base thereof by said drive unit, said drive unit for rotating said post being accommodated inside said footing.

15. Apparatus according to claim 12, wherein said further sensor means comprise a lower sensor and an upper sensor, adapted to report a movement of said lifting element respectively in said lowered and raised positions, and an intermediate sensor, adapted to report a disengagement of said lifting element from a region where said reels are fed, said lower, upper and intermediate sensors being arranged in positions located longitudinally with respect to said post.

16. Apparatus according to claim 15, wherein the position of said upper sensor is adjustable longitudinally with respect to said post for varying a lifting height of said lifting element.

17. Apparatus according to claim 12, further comprising abutment means provided at said driving unit for interacting with said sensor means to control the angular rotation of said post.

18. Apparatus according to claim 12, further comprising: a rod protruding horizontally from said platform; centering rollers rotatably supported on said rod for rotating about a vertical axis, said rollers being adapted to engage a guide which lies longitudinally in a median region of said cart; and L-shaped means adapted to be engaged by a hook which is pivoted at a front region of said cart.

19. Apparatus according to claim 12, wherein said lifting element comprises two pins which are arranged side by side and protrude horizontally, in a fork-like manner, at the base of a backing panel, said backing panel being connected to means for slidingly moving said lifting element, whereby said panel is guided longitudinally with respect to said post, said pins having a slight taper so as to incline a reel resting thereon against said backing panel.

* * * * *